US007669654B2

(12) United States Patent
Artherholt

(10) Patent No.: US 7,669,654 B2
(45) **Date of Patent: *Mar. 2, 2010**

(54) CUP TOOL WITH THREE-PART PACKOFF FOR A HIGH PRESSURE MANDREL

(75) Inventor: Danny Lee Artherholt, Asher, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/243,024

(22) Filed: Oct. 1, 2008

(65) Prior Publication Data

US 2009/0038791 A1 Feb. 12, 2009

Related U.S. Application Data

(63) Continuation of application No. 11/398,182, filed on Apr. 5, 2006, now Pat. No. 7,434,617.

(51) Int. Cl.
*E21B 33/12* (2006.01)

(52) U.S. Cl. ..... 166/202; 166/191

(58) Field of Classification Search ..... 166/202, 166/387, 191; 277/336, 342, 339
See application file for complete search history.

(56) References Cited

U.S. PATENT DOCUMENTS

| | | | |
|---|---|---|---|
| 3,456,724 | A | 7/1969 | Brown |
| 3,830,304 | A | 8/1974 | Cummins |
| 4,023,814 | A | 5/1977 | Pitts |
| 4,111,261 | A | 9/1978 | Oliver |
| 4,601,494 | A | 7/1986 | McLeod |
| 4,706,747 | A | 11/1987 | Schneider |
| 4,867,243 | A | 9/1989 | Garner et al. |
| 4,961,465 | A | 10/1990 | Brandell |
| 4,993,489 | A | 2/1991 | McLeod |
| 5,060,723 | A | 10/1991 | Sutherland et al. |
| 5,261,487 | A | 11/1993 | McLeod et al. |
| 5,501,280 | A | 3/1996 | Brisco |
| 5,957,198 | A | 9/1999 | Hayes |
| 6,173,777 | B1 | 1/2001 | Mullins |
| 6,470,965 | B1 | 10/2002 | Winzer |
| 6,626,245 | B1 | 9/2003 | Dallas |
| 6,817,421 | B2 | 11/2004 | Dallas |
| 6,823,942 | B1 | 11/2004 | McGee |

(Continued)

FOREIGN PATENT DOCUMENTS

| | | |
|---|---|---|
| CA | 2 503 790 | 5/2006 |

*Primary Examiner*—Jennifer H Gay
*Assistant Examiner*—Cathleen R Hutchins
(74) *Attorney, Agent, or Firm*—Nelson Mullins Riley & Scarborough, LLP

(57) ABSTRACT

A cup tool for use with a high-pressure mandrel of a wellhead isolation tool has a three-part packoff assembly that slides over a cup tool tube from an unset position to a set position. The three-part packoff assembly includes an elastomeric cup, a rigid alignment ring located above the elastomeric cup and an elastomeric packoff element located above the rigid alignment ring. The rigid alignment ring helps ensure that the elastomeric cup remains correctly aligned in a casing or tubing that is not straight, is out of round or is washed, and helps ensure that the elastomeric packoff achieves a high-pressure seal in the set position, even under adverse downhole conditions.

20 Claims, 9 Drawing Sheets

U.S. PATENT DOCUMENTS

| | | | | |
|---|---|---|---|---|
| 6,918,441 | B2 | 7/2005 | Dallas | |
| 7,159,663 | B2 | 1/2007 | McGuire et al. | |
| 7,207,384 | B2 | 4/2007 | Dallas et al. | |
| 7,243,733 | B2 | 7/2007 | McGuire et al. | |
| 7,278,477 | B2 | 10/2007 | McGuire, et al. | |
| 7,380,592 | B2 | 6/2008 | Atkins et al. | |
| 7,434,617 | B2 * | 10/2008 | Artherholt | 166/202 |
| 2006/0102339 | A1 * | 5/2006 | Cherewyk | 166/202 |

* cited by examiner

CUP TOOL WITH THREE-PART PACKOFF FOR A HIGH PRESSURE MANDREL

RELATED APPLICATIONS

This is a continuation of U.S. patent application Ser. No. 11/398,182 filed Apr. 5, 2006.

FIELD OF THE INVENTION

This invention generally relates to well stimulation tools and, in particular, to a cup tool with a three-part packoff for a high-pressure mandrel of a well stimulation tool for isolating pressure-sensitive wellhead components during high-pressure fracturing and stimulation of oil and gas wells. The cup tool is of particular utility in adverse downhole conditions.

BACKGROUND OF THE INVENTION

Most oil and gas wells require some form of stimulation to enhance hydrocarbon flow to make or keep them economically viable. The servicing of oil and gas wells to stimulate production requires the pumping of fluids under high pressure. The fluids may be low temperature or caustic and are frequently abrasive because they are laden with abrasive propants such as sharp sand, bauxite or ceramic granules.

In order to protect the components which make up the wellhead, such as the valves, tubing hanger, casing hanger, casing head and blowout preventer equipment, wellhead isolation tools are used during well fracturing and well stimulation procedures. The wellhead isolation tools generally work on a principal of inserting a high-pressure mandrel through various pressure-sensitive valves and spools of the wellhead to isolate those wellhead components from elevated fluid pressures and from low temperature or corrosive and/or abrasive fluids used during the well stimulation treatment to stimulate production from the well. One example of those wellhead isolation tools is described in the Assignee's U.S. Pat. No. 6,626,245, entitled BLOWOUT PREVENTER PROTECTOR AND METHOD OF USING SAME. Another example of such a tool is described in the Assignee's U.S. Pat. No. 4,867,243, which issued Sep. 19, 1989 and is entitled WELLHEAD ISOLATION TOOL AND SETTING TOOL AND METHOD OF USING SAME. In those examples, a top end of the mandrel is connected to one or more high pressure valves through which the well stimulation fluids are pumped. A pack-off assembly is provided at a bottom end of the mandrel for achieving a fluid seal against an inside of a production tubing or well casing, so that the wellhead is completely isolated from the well stimulation fluids.

Various pack-off assemblies, commonly referred to as "cup tools", provided at a bottom end of the mandrel of wellhead isolation tools are described in other prior art patents, such as U.S. Pat. No. 4,023,814, entitled A TREE SAVER PACKER CUP, which issued to Pitts on May 17, 1977; U.S. Pat. No. 4,111,261, entitled A WELLHEAD ISOLATION TOOL, which issued to Oliver on Sep. 5, 1978; U.S. Pat. No. 4,601,494, entitled A NIPPLE INSERT, which issued to McLeod et al. on Jul. 22, 1986; U.S. Pat. No. 5,261,487, entitled PACK-OFF NIPPLE, which issued on Nov. 16, 1993 to McLeod, et al; Assignee's U.S. Pat. No. 6,918,441 entitled CUP TOOL FOR HIGH PRESSURE MANDREL which issued Jul. 19, 2005; and, Assignee's published U.S. Patent application 20040055742 entitled CUP TOOL FOR HIGH PRESSURE MANDREL which was published on Mar. 25, 2004. These pack-off assemblies include a cup tool and/or a packoff element that radially expands under high fluid pressures to seal against the inside wall of a production tubing or casing.

Although at least some of the prior art cup tools provide an adequate seal under most downhole conditions, they do not always provide a reliable seal in tubing or casing that is bent or out-of-round. They may also fail to provide a reliable seal when low temperature, very caustic or solvent-laden fluids are used for a well stimulation treatment. All low temperature, highly caustic and solvent-laden fluids stress the materials used to make elastomeric sealing cups and/or packoff elements used to achieve the high pressure seals. That stress can lead to seal failure, especially if a casing or tubing string into which the cup tool is inserted is not straight or is out-of-round.

There is therefore a need for a reliable cup tool for a high pressure mandrel used for injecting low temperature, caustic and/or solvent-laden well stimulation fluids.

SUMMARY OF THE INVENTION

It is therefore an object of the invention to provide a cup tool for a high pressure mandrel used for injecting well stimulation fluids into a well and, in particular, for injecting such fluids under adverse downhole conditions.

The invention therefore provides a cup tool for providing a high-pressure fluid seal in an annulus between a high-pressure mandrel and a production casing or a production tubing in a wellbore, comprising: a cup tool tube having a threaded upper end for connection to the high-pressure mandrel; a three-part packoff assembly that slides over the cup tool tube from an unset position to a set position, the three-part packoff assembly including an elastomeric cup, a rigid alignment ring located above the elastomeric cup and an elastomeric packoff element located above the rigid alignment ring.

The invention further provides a cup tool for providing a high-pressure fluid seal in an annulus between a high-pressure mandrel and a casing or a production tubing in a wellbore, comprising: a cup tool tube having a threaded upper end for connection to the high-pressure mandrel; a three-part packoff assembly that slides over the cup tool tube from an unset position to a set position, the three-part packoff assembly including an elastomeric cup, a rigid alignment ring located above the elastomeric cup and an elastomeric packoff element located above the rigid alignment ring; and a gauge ring located above the elastomeric packoff element, the gauge ring comprising one of: at least two sloped shoulders; at least two right-angled shoulders; and, a single sloped shoulder.

The invention further provides a cup tool for providing a high-pressure fluid seal in an annulus between a high pressure mandrel and a casing or a production tubing in a wellbore, comprising: a first cup tool tube having a threaded upper end for connection to the high-pressure mandrel; a first three-part packoff assembly that slides over the first cup tool tube from an unset position to a set position, the three-part packoff assembly including an elastomeric cup, a rigid alignment ring located above the elastomeric cup and an elastomeric packoff element located above the rigid alignment ring; a second cup tool tube having a threaded upper end for connection to the first cup tool tube; and a second three-part packoff assembly that slides over the second cup tool tube from an unset position to a set position, the second three-part packoff assembly including an elastomeric cup, a rigid alignment ring located above the elastomeric cup and an elastomeric packoff element located above the rigid alignment ring.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a cup tool for achieving a reliable high-pressure fluid seal in an annulus between a high pressure mandrel and a casing or production tubing in a wellbore under adverse downhole conditions. For example, when a casing or tubing in which the cup tool must pack off is not straight, is out-of-round or is "washed", or when low temperature, caustic, or solvent-laden fluids are pumped into the wellbore. The cup tool includes a three-part packoff assembly that slides over a cup tool tube from an unset to a set position. The three-part packoff assembly includes an elastomeric cup, a rigid alignment ring located above the elastomeric cup and an elastomeric packoff element located above the rigid alignment ring. The rigid alignment ring helps ensure that the elastomeric packoff element achieves a reliable high pressure seal under adverse downhole conditions.

Figure 1:
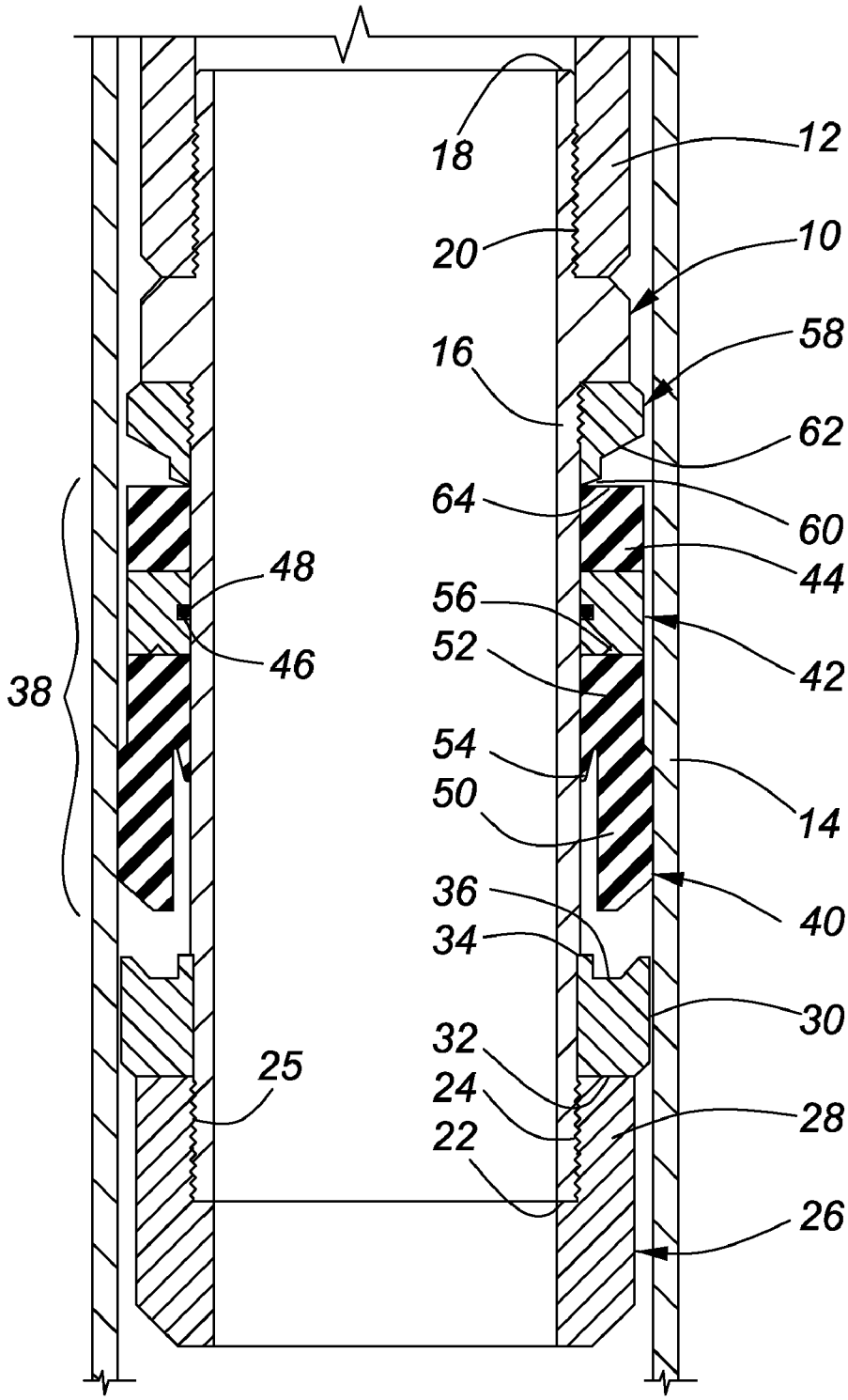
FIG. 1 is a cross-sectional view of a cup tool in accordance with one embodiment of the invention, shown in an unset condition.

As shown in FIG. 1, a cup tool in accordance with one embodiment of the invention, generally indicated by reference numeral 10, is attached to a bottom end of a high-pressure mandrel 12 and is inserted into a production tubing or production casing, hereinafter referred to simply as a production tubing 14. The cup tool 10 includes a cup tool tube 16 which has an upper end 18 provided with pin threads 20 for connecting the cup tool tube 16 to the high-pressure mandrel 12. The cup tool tube 16 terminates at its bottom end 22 in a bullnose 26, which guides the cup tool 10 through a wellhead (not shown) and the production tubing 14, and helps protect an elastomeric sealing element, such as elastomeric cup 40 operatively mounted to the cup tube 16. In this embodiment, the bullnose 26 is a two-part element that is threadedly connected to the cup tool tube by box threads 25 that engage pin threads 24 provided on an outer surface of the bottom end 22 of the cup tool tube.

The bullnose 26 includes a tool guide 28 that guides the cup tool 10 down through the wellhead components and the production tubing 14, as explained above. Only one diameter of tool guide 28 is required for any given diameter of cup tool tube 16. Located above the tool guide 28, and in this embodiment retained on the cup tool tube 16 by the tool guide 28, is a cup guard 30. The cup guard 30 is retained by a top end 32 of the tool guide 28 against an annular shoulder 34 formed on the cup tool tube 16. The cup guard 30 has a diameter that is selected to be compatible with an internal diameter of the production tubing 14, into which the cup tool 10 is being run. As understood by those skilled in the art, the internal diameter of the production tubing 14 is determined by an outer diameter and weight per linear unit of the production tubing 14. The cup guard 30 includes an annular groove 36 in its top end that receives and protects a bottom end of the elastomeric cup 40 when the cup tool 10 is extracted from the production tubing 14. The cup guard 30 also helps ensure that the cup tool tube 16 remains parallel with a production tubing 14, which increases the probability of a successful pack-off.

The cup tool 10 has a three-part packoff assembly 38 that includes the elastomeric cup 40, a rigid alignment ring 42 and an elastomeric packoff element 44. The elastomeric cup 40, the rigid alignment ring 42 and the elastomeric packoff element 44 are respectively annular elements that surround the cup tool tube 16. In one embodiment, the elastomeric cup 40 and the elastomeric packoff element 44 are made of a polymer, e.g. a polyurethane having a consistent durometer of 80-90. In one embodiment, the rigid alignment ring 42 is made of steel or plated steel for sweet well service, and stainless steel for sour well service. The rigid alignment ring 42 is slidably received on the cup tool tube 16 and includes an annular groove 46 in its inner periphery. An O-ring 48 is received in the groove 46 and provides a fluid seal between the rigid alignment ring 42 and the cup tool tube 16.

The elastomeric cup 40 further includes a depending skirt 50, which extends downwardly from a cup body 52 and is formed integrally therewith. The depending skirt 50 has an outer diameter that is about the same as, or slightly larger than, the inner diameter of the production tubing 14. The depending skirt 50 is open at its bottom end, and forms a sealed cavity around the cup tool tube 16 that is closed at a top end by an inwardly biased lip 54, so that when the elastomeric cup 40 is exposed to fluid pressure the elastomeric cup 40 is forced to slide upwardly on the cup tool tube 16.

The rigid alignment ring 42 separates the elastomeric cup 40 from the elastomeric packoff element 44. All three parts of the pack-off assembly 38 slide freely over the cup tool tube 16 between the cup guard 30 and a gauge ring 58, which respectively provide a lower and an upper travel limit for the three-part packoff assembly 30. In this embodiment, the rigid alignment ring 42 includes an annular V-shaped groove 56 in a bottom surface thereof. The V-shaped groove 56 provides an annular space into which a top edge of the elastomeric cup 40 extrudes when the elastomeric cup 40 is exposed to elevated fluid pressures. The groove 56 inhibits a top end of the elastomeric cup 40 from extruding into a space between the rigid alignment ring 42 and the production tubing 14.

Figure 2:
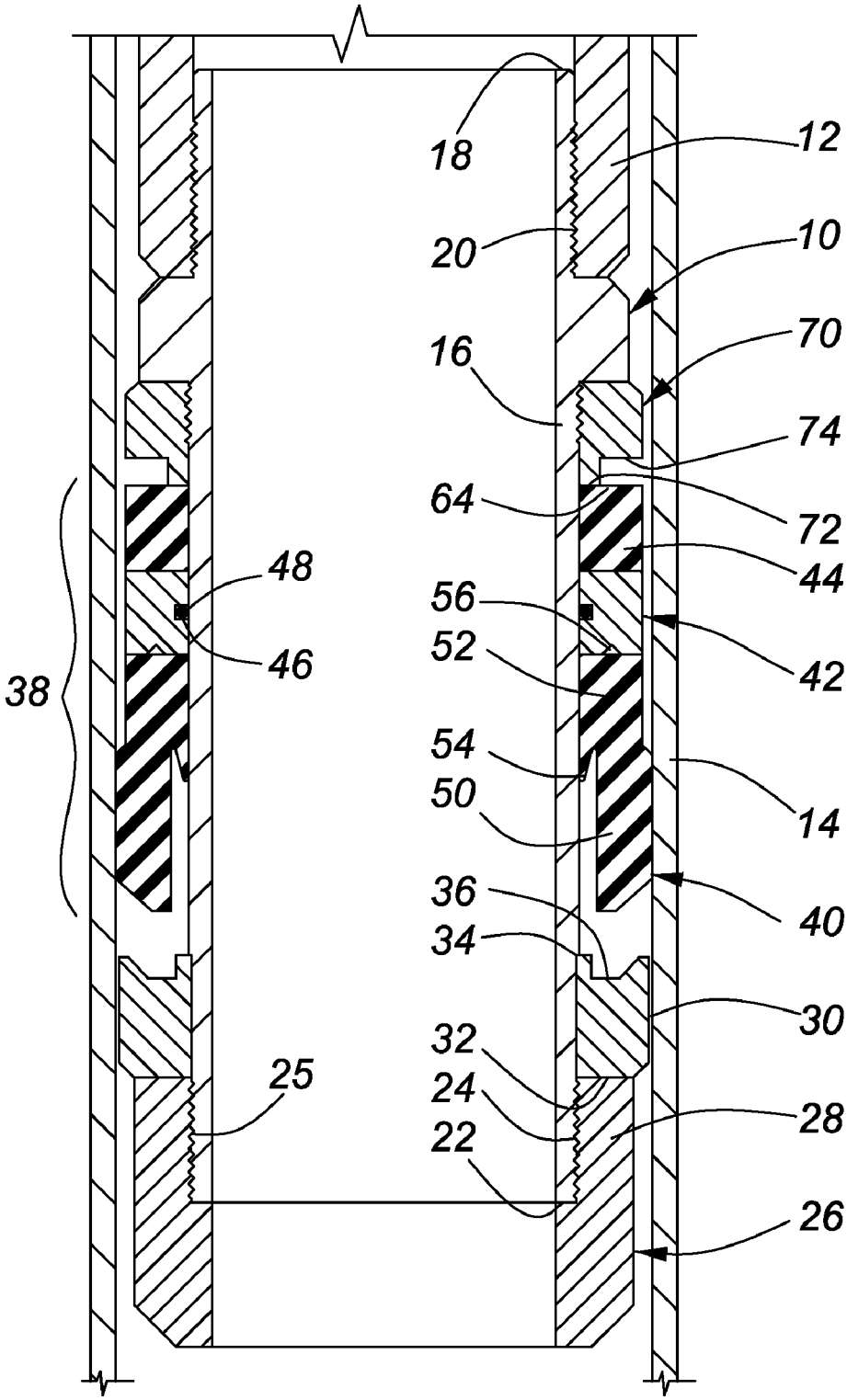
FIG. 2 is a cross-sectional view of a second embodiment of the cup tool in accordance with the invention, shown in an unset condition.
Figure 3:
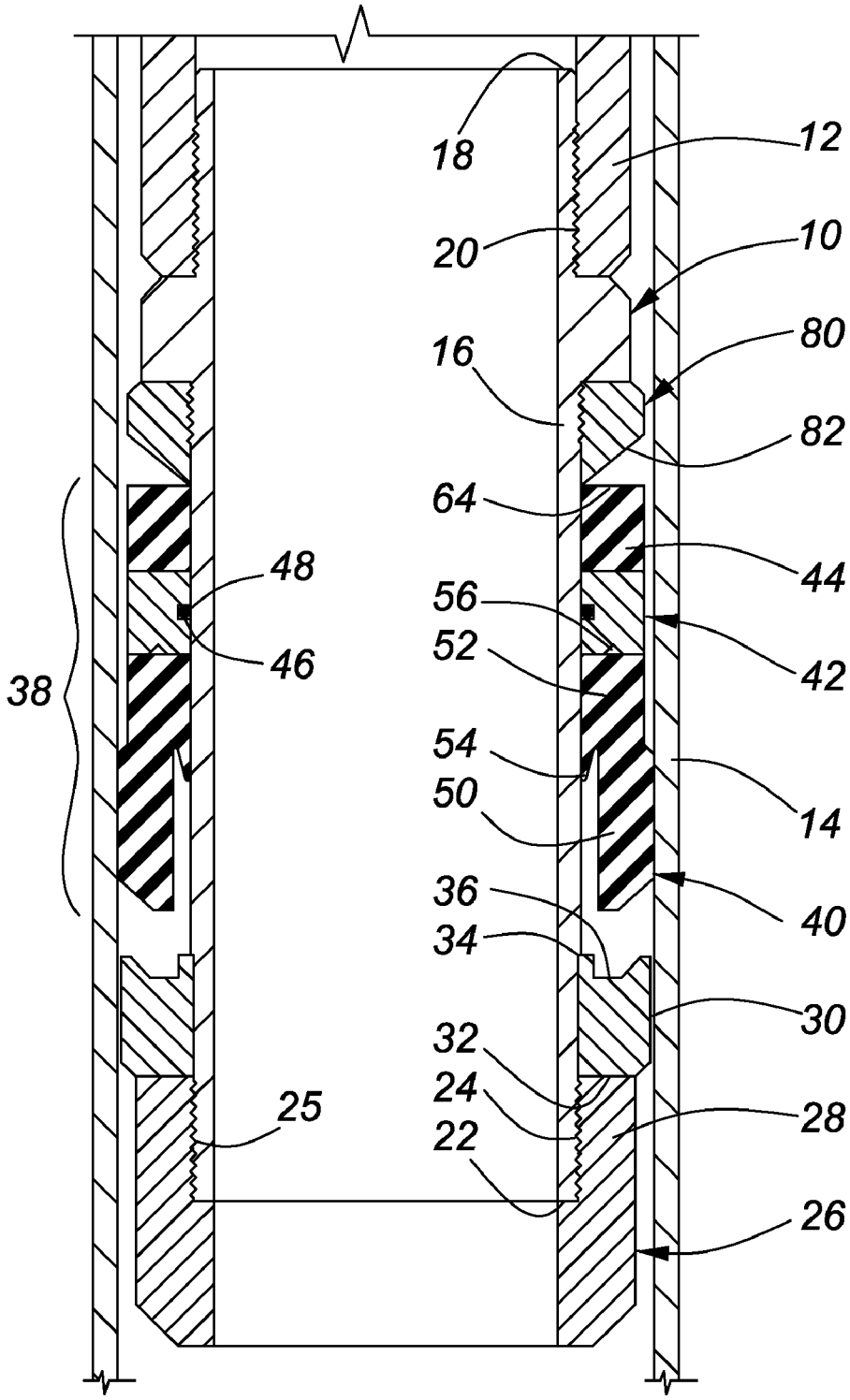
FIG. 3 is a cross-sectional view of a third embodiment of the cup tool in accordance with the invention, shown in an unset condition.

The packoff element 44 is located above the rigid alignment ring 42 and extrudes up over the gauge ring 58 when the elastomeric cup 40 is forced upwardly by fluid pressure, as will be explained below in more detail with reference to FIG. 3. In this embodiment, the gauge ring 58 includes a first upwardly-angled shoulder 60 and a second upwardly-angled shoulder 62 over which a top edge 64 of the packoff element 44 is forced when the packoff assembly 38 is exposed to high fluid pressures below the cup tool 10 within the production tubing 14. In other embodiments of the cup tool 10, the gauge ring 58 has square shoulders, as shown in FIG. 2, or a single-bevel shoulder as shown in FIG. 3.

The rigid alignment ring 42 helps ensure a reliable seal when the packoff assembly 38 is set in a production tubing 14 that is not straight, is out-of-round or is washed, i.e. has been eroded by abrasive propants pumped through it. Because the rigid alignment ring is located between the elastomeric cup 40 and the packoff element 44, it inhibits distortion of those elastomeric elements when they are exposed to unbalanced stresses as they encounter in a tubing 14 that is not straight, is out-of-round or is washed. A more reliable fluid seal is thereby by achieved.

As well, the rigid alignment ring 42 is less affected by low temperatures than the elastomeric cup 40 or the elastomeric packoff element 44. Consequently, when very low temperature fluids such as carbon dioxide, liquid nitrogen, liquid natural gas or the like is used as a well stimulation fluid the rigid alignment ring 42 provides a stable buffer between the elastomeric cup 40 and the elastomeric packoff element 44 that helps to reduce stress and inhibit low temperature induced cracking, which could cause the high pressure fluid seal to be lost.

Likewise, if very caustic or solvent-laden stimulation fluids are used for a well treatment, the rigid alignment ring 42, which is unaffected or marginally affected by those fluids, provides a stable buffer below the elastomeric packoff element 44 that protects the elastomeric packoff element 44 even if an integrity of the elastomeric cup 40 is compromised by those stimulation fluids.

Figure 5:
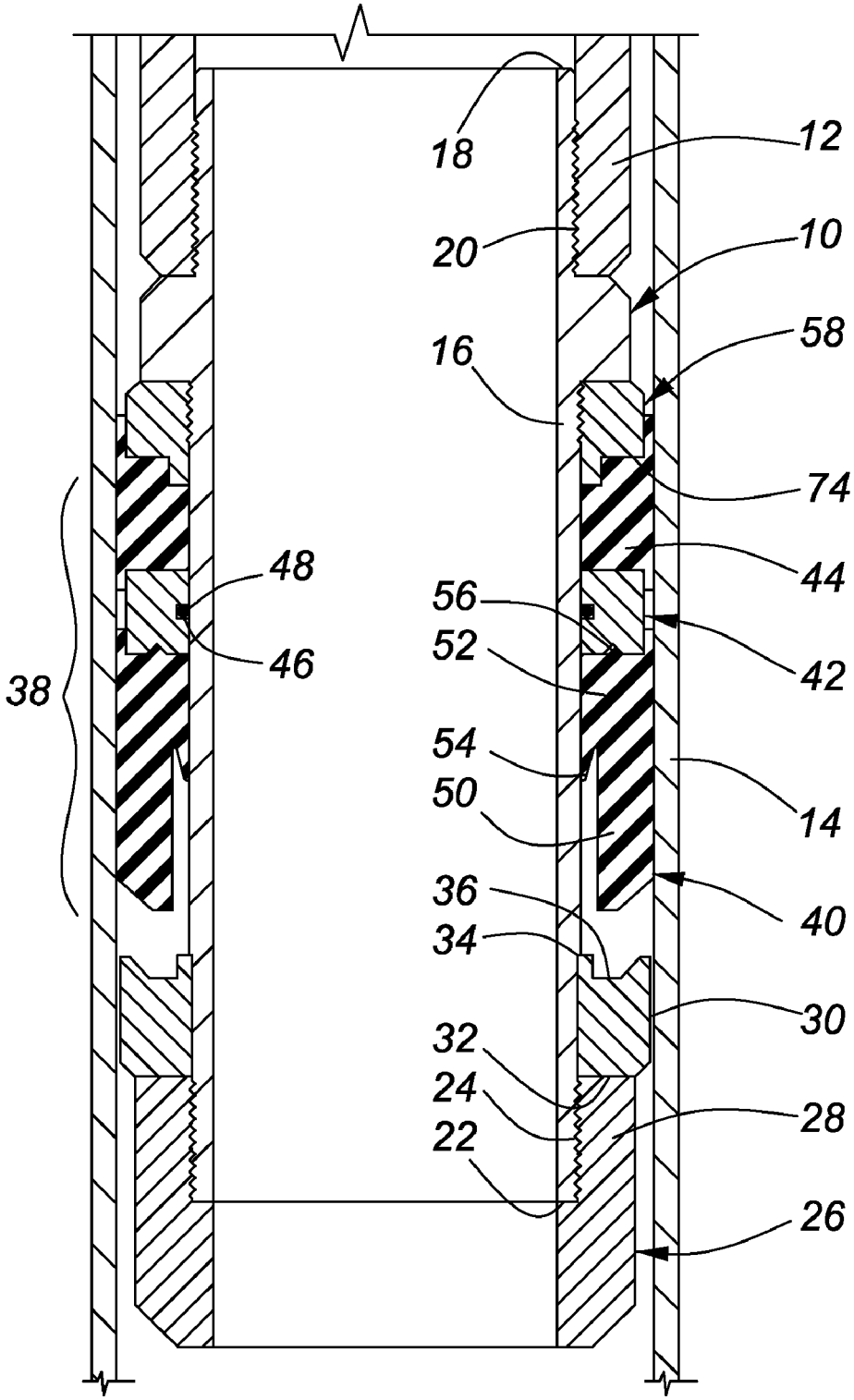
FIG. 5 is a cross-sectional view of the embodiment shown in FIG. 2 in a set condition.

FIG. 2 is a schematic diagram of a second embodiment of the cup tool 10 in accordance with the invention. The cup tool 10 shown in FIG. 2 is identical to the cup tool 10 shown in FIG. 1 with the exception that the gauge ring 70 has square rather than sloped shoulders. The gauge ring 70 shown in FIG. 2 has a first square shoulder 72 and a second square shoulder 74. As will be understood by those skilled in the art, the gauge ring 70 may have more than two square shoulders. The stepped shoulder gauge ring 70 guides the packoff element 44 to a set condition when the elastomeric cup 40 is subjected to high fluid pressures, as shown in FIG. 5.

Otherwise, the cup tool 10 shown in FIG. 2 functions in the same way as described above a with reference to FIG. 1. The balance of the cup tool components shown in FIG. 2 will therefore not be further described.

Figure 6:
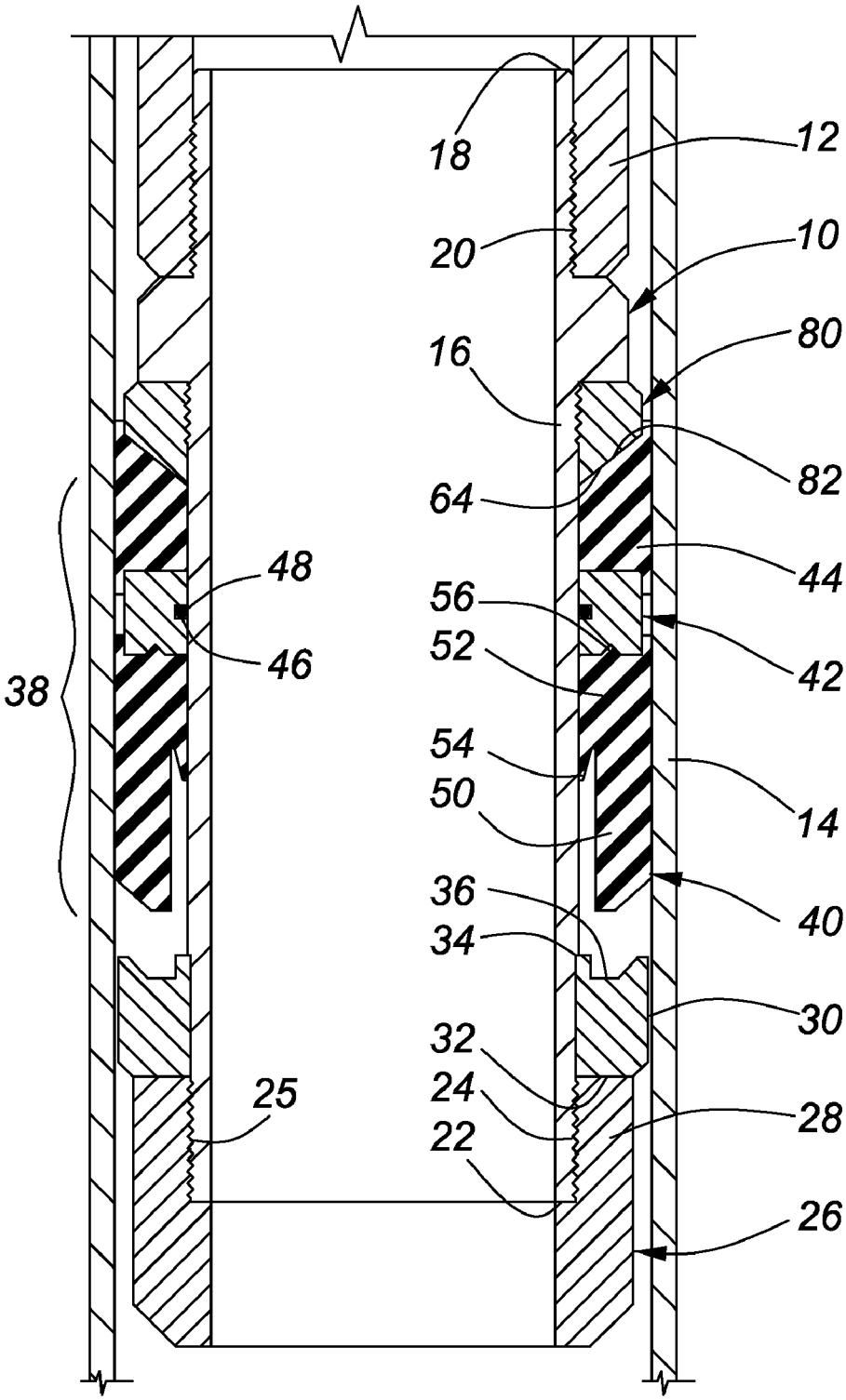
FIG. 6 is a cross-sectional view of the embodiment shown in FIG. 3 in a set condition.

FIG. 3 is a schematic diagram of yet another embodiment of the cup tool 10 in accordance with the invention. The embodiment of the cup tool 10 shown in FIG. 3 is identical to the embodiment shown in FIGS. 1 and 2 with the exception that the gauge ring 80 has a single sloped face 82. The single sloped face 82 is inclined at an angle of about 30°-70° and guides the packoff element 44 to a set condition when the elastomeric cup 14 is subjected to high fluid pressures, as is shown in FIG. 6.

Otherwise, the cup tool 10 shown in FIG. 3 functions in the same way as described above a with reference to FIG. 1. The balance of the cup tool components shown in FIG. 3 will therefore not be further described.

Figure 4:
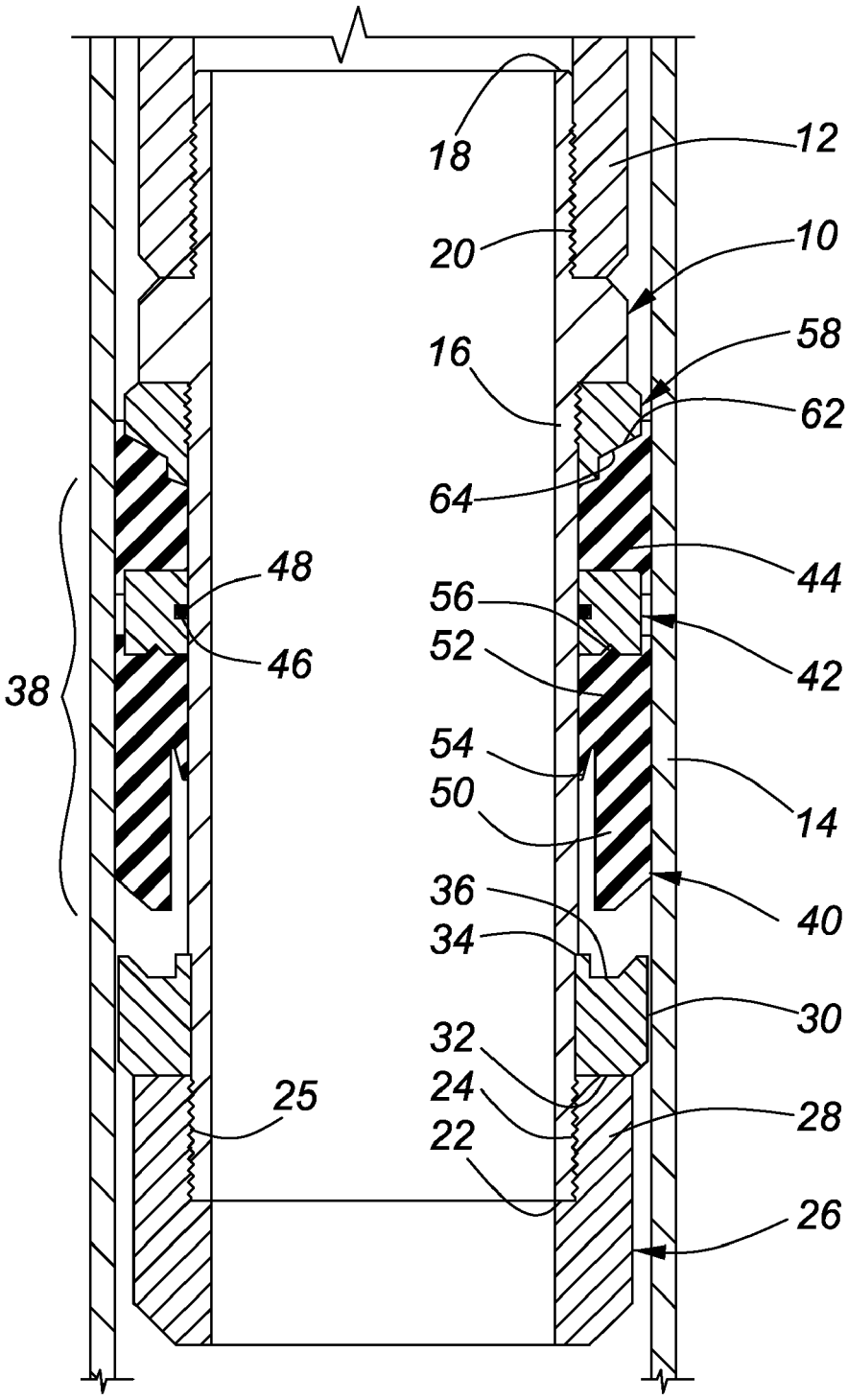
FIG. 4 is a cross-sectional view of the embodiment shown in FIG. 1 in a set condition.

FIG. 4 is a schematic diagram of the cup tool shown in FIG. 1 in a set condition. As is well understood in the art, the function of the cup tool 10 is to move to the set condition after the cup tool 10 has been inserted into a production tubing 14 and fluid under high pressure is pumped into the production tubing 14, such as is performed during a well stimulation treatment. When subjected to high fluid pressures, the elastomeric cup 40 traps fluid pressure beneath the inwardly biased lip 54 and the elastomeric cup 40 is forced upwardly over the cup tool tube 16. Upward movement of the elastomeric cup 40 forces the rigid alignment ring 42 upward over the cup tool tube 16, which in turn compresses the packing element 44 and forces the packing element 44 upwards over the inclined shoulders 60 and 62 of the gauge ring 58. When the packing element 44 is forced over the first inclined shoulder 60, a fluid seal is obtained between the cup tool 10 and the production tubing 14. If the fluid pressure is high enough, the packing element 44 continues to be extruded upwardly over the second shoulder 62 and into a space between the gauge ring 58 and the production tubing 14.

FIG. 5 is a schematic diagram of the cup tool 10 shown in FIG. 2 in the set condition. All of the elements of the cup tool 10 shown in FIG. 5 have been described above with reference to FIGS. 1 and 2, and they will not be described again. As will be understood by those skilled in the art and described in Applicant's above-referenced U.S. Pat. No. 6,918,441, the substantially right-angled stepped shoulders a 72, 74 over which the elastomeric packoff element 44 is forced inhibits extrusion past the stepped shoulder 72 during insertion of the mandrel into the production tubing 14, thereby reducing a risk of damaging the packoff element 44 before the mandrel 12 is fully inserted through the wellhead.

FIG. 6 is a schematic diagram of the cup tool 10 shown in FIG. 3 in a set condition. All the elements of the cup tool 10 shown in FIG. 6 have been described above with reference to FIGS. 1 and 3. As will be understood by those skilled in the art, the gauge ring 58 with the single sloped face 82 guides the packoff element 44 to the set condition as shown when the cup tool 10 is subjected to elevated fluid pressures within the production tubing 14.

Figure 7:
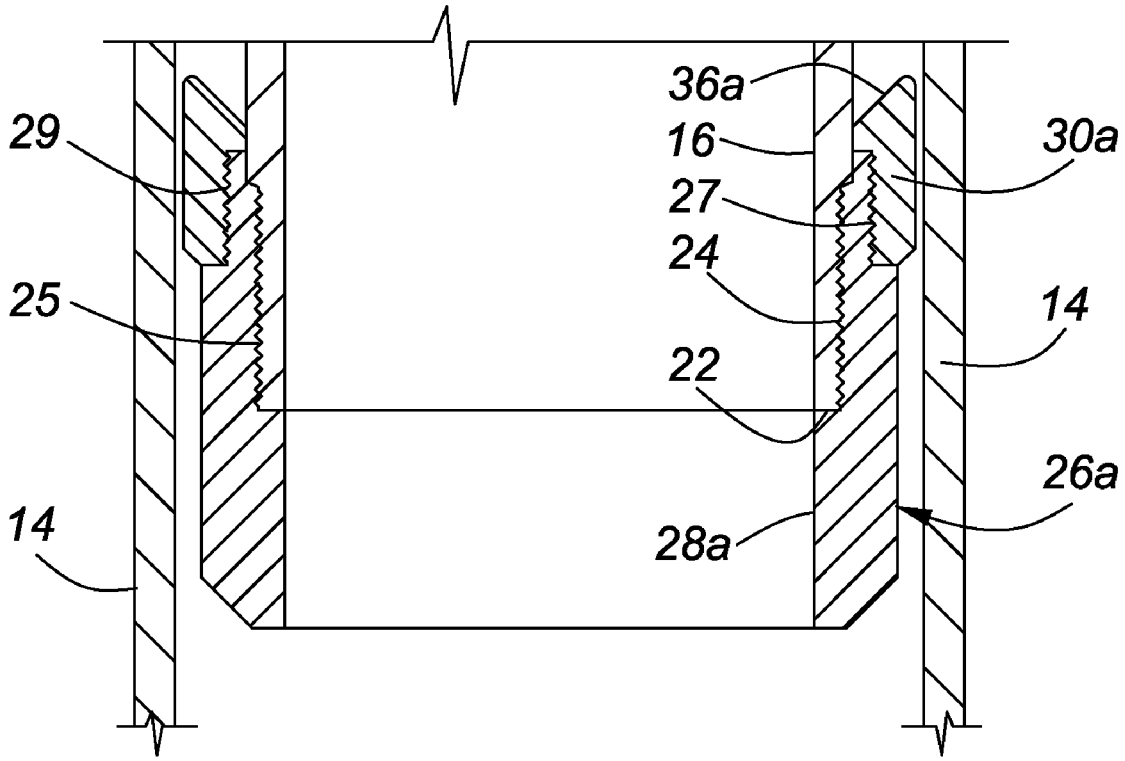
FIG. 7 is a cross-sectional view of an alternate embodiment of a bullnose for the cup tools shown in FIGS. 1-3.

FIG. 7 is a cross-sectional schematic diagram of an alternate embodiment of a bullnose **26*a* in accordance with the invention. In this embodiment, a tool guide 28*a* is identical to the tool guide the 28 described above with reference to FIGS. 1-3, except that a cup guard 30*a* is configured differently and is threadedly secured to the tool guide 28*a* by pin threads 27 on an outer circumference of the tool guide 28*a*. The pin threads 27 mate with complementary box threads 29 on an inner periphery of the cup guard 30*a*. An annular groove 36*a* formed between a top surface of the cup guard 30*a* and the cup tool tube 16 receives a bottom end of the elastomeric cup 40 shown in FIGS. 1-3. The bullnose 26*a* is particularly useful when tolerances do not permit the formation of the shoulder 34 on the cup tool tube 16 shown in FIGS. 1-3**.

Figure 8:
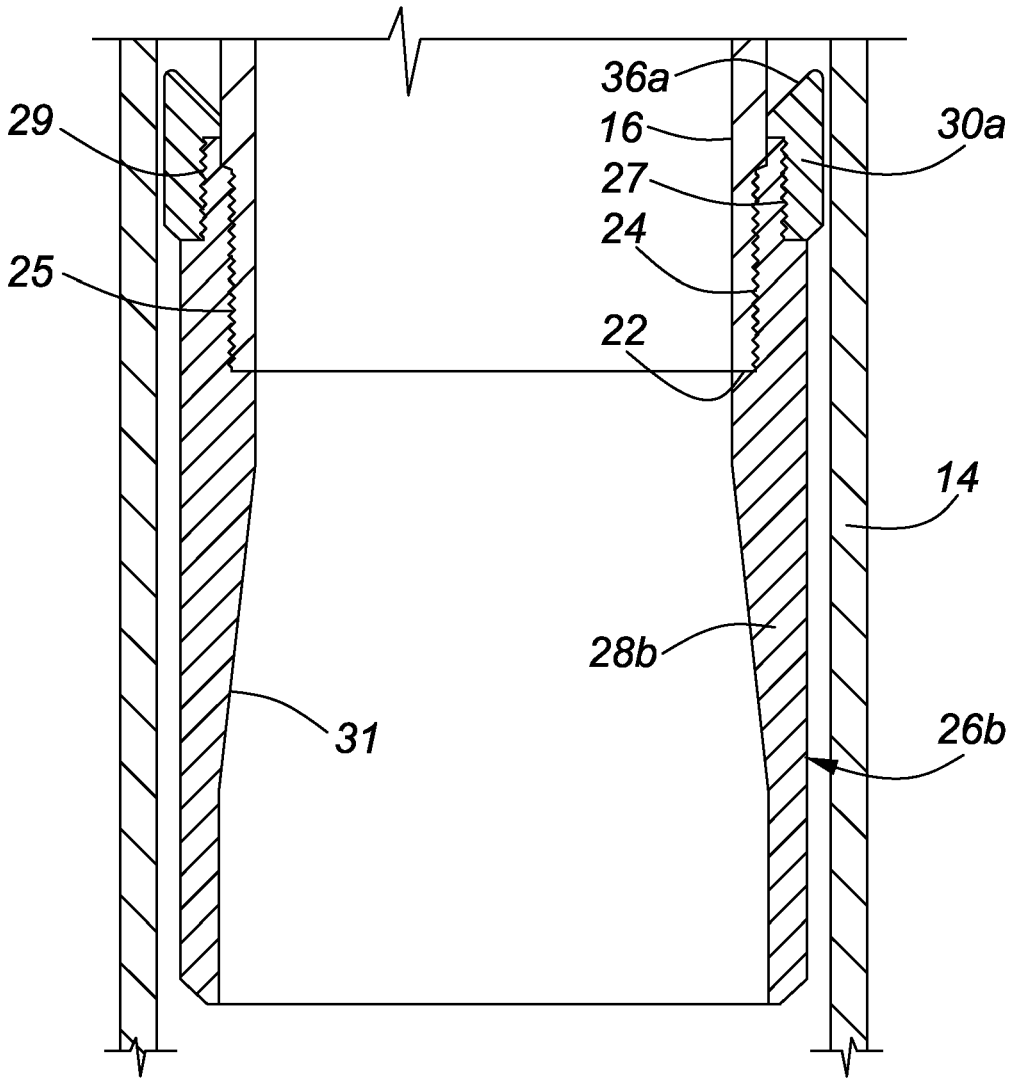
FIG. 8 is a cross-sectional view of another alternate embodiment of a bullnose for the cup tools shown in FIGS. 1-3.

FIG. 8 is a cross-sectional schematic diagram of a further embodiment of a bullnose **26*b* having a configuration useful for applications where high fluid flow rates are required. The bullnose 26*b* is similar to the bullnose 26*a* described above with reference to FIG. 7, with the exception that the tool guide 28*b* is longer than the tool guide 28*a* shown in FIG. 7, and an interior wall 31 of the tool guide at 28*b* is outwardly flared towards the bottom end to permit high pressure fluids to expand before they enter the production tubing 14**.

The bullnoses **26*a*, 26*b* shown in FIGS. 7 and 8 can be used on any of the cup tools described above with reference to FIGS. 1-3, as well as with a double cup tool described below with reference to FIG. 9**.

Figure 9:
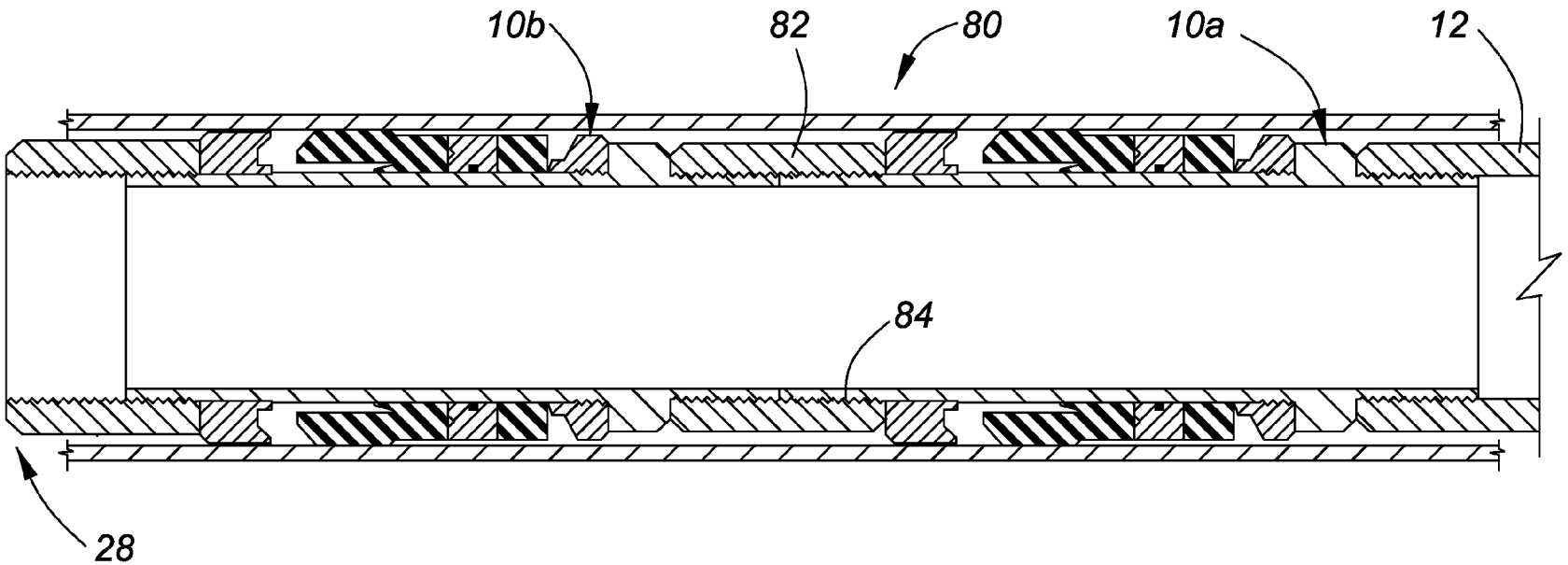
FIG. 9 is a cross-sectional view of yet another embodiment of the invention, which provides a double cup tool.

FIG. 9 is a cross-sectional view of yet another embodiment of a cup tool in accordance with the invention. In this embodiment, a double cup tool 80 is provided. The double cup tool 80 has the advantage of providing a redundant backup packoff and places an elastomeric seal in two spaced-apart locations in the production tubing 14. The cup tool 80 is made up from any combination of the embodiments shown in FIGS. 1-3. In this exemplary embodiment, two of the cup tools shown in FIG. 1 are connected together using a connecting collar 82 after the tool guide 28 is removed from the first cup tool **10*a*. The second cup tool 10*b* is secured to a bottom end of the connecting collar 82 by pin threads 20 (FIG. 1) that engage complementary box threads 84 in the connecting collar 82. In all other respects, the double cup tool 80 is the same as the cup tool described above with reference to FIG. 1** and the other components will not be redundantly described.

As will be understood by those skilled in the art, the embodiments of the invention described above are intended to be exemplary only. The scope of the invention is therefore intended to be limited solely by the scope of the appended claims.

I claim:

1. A cup tool for providing a high-pressure fluid seal within a casing or a production tubing, comprising:

a cup tool tube adapted to be connected to a high-pressure mandrel inserted into the casing or the production tubing;

a three-part packoff assembly that slides over the cup tool tube, the three-part pack off assembly comprising an elastomeric cup that surrounds the cup tool tube, a rigid alignment ring that surrounds the cup tool tube above a top end of the elastomeric cup, an annular groove in a bottom surface of the rigid alignment ring, and an elastomeric packoff element that surrounds the cup tool tube above a top end of the rigid alignment ring.

2. The cup tool as claimed in claim 1 wherein the elastomeric cup comprises a depending skirt having an open bottom end that forms a sealed cavity around the cup tool tube, the sealed cavity being closed at a top end by an inwardly biased lip of the elastomeric cup.

3. The cup tool as claimed in claim 1 further comprising a gauge ring located above the packoff element to inhibit the three-part packoff assembly from moving to a set condition while the high-pressure mandrel is being inserted through the wellhead into the casing or the production tubing.

4. The cup tool as claimed in claim 3 wherein the gauge ring comprises at least one sloped shoulder.

5. The cup tool as claimed in claim 3 wherein the gauge ring comprises at least one substantially right-angled shoulder.

6. The cup tool as claimed in claim 3 wherein the gauge ring comprises at least two sloped shoulders.

7. The cup tool as clamed in claim 1 wherein the elastomeric cup and the elastomeric packoff element respectively comprise an elastomer of the same durometer.

8. The cup tool as claimed in claim 1 wherein a bottom end of the cup tool tube terminates in a bullnose that guides the cup tool into the casing or the production tubing.

9. The cup tool as claimed in claim 8 wherein the bullnose comprises a cup guard having an annular groove in a top end thereof, the annular groove receiving and protecting a bottom end of the elastomeric cup.

10. The cup tool as claimed in claim 9 wherein the bullnose comprises box threads for securing the bullnose to the cup tool tube, and the cup guard is retained on the cup tool by the bullnose.

11. The cup tool as claimed in claim 9 wherein the bullnose comprises box threads for securing the bullnose to the cup tool tube and pin threads for securing the cup guard to a top end of the bullnose.

12. The cup tool as claimed in claim 1 wherein the rigid alignment ring comprises a steel ring.

13. A cup tool for providing a high-pressure fluid seal within a casing or a production tubing, comprising:

a cup tool tube having a threaded upper end adapted to connect to a high-pressure mandrel;

a three-part packoff assembly that slides over the cup tool tube, the three-part pack off assembly comprising an elastomeric cup that surrounds the cup tool tube, a rigid alignment ring that surrounds the cup tool tube above a top end of the elastomeric cup, an annular groove in a bottom surface of the rigid alignment ring, and an elastomeric packoff element that surrounds the cup tool tube above a top end of the rigid alignment ring; and a gauge ring located above a top end of the elastomeric packoff element, the gauge ring comprising one of: at least one sloped shoulder; and, at least one right-angled shoulder.

14. The cup tool as claimed in claim 13 further comprising a bullnose connected to a bottom end of the cup tool tube, the bullnose comprising a tool guide that guides the cup tool into the casing or the production tubing, and a cup guard having a top end with an annular groove that receives and protects a bottom end of the elastomeric cup.

15. The cup tool as claimed in claim 13 wherein the elastomeric cup comprises a depending skirt having an open bottom end, the depending skirt being adapted to form a sealed cavity around the cup tool tube that is closed at a top end by an inwardly biased lip, so that when the elastomeric cup is exposed to fluid pressure the elastomeric cup is forced to slide upwardly on the cup tool tube.

16. A cup tool for providing a high-pressure fluid seal in a casing or a production tubing, comprising:

a first cup tool tube having a threaded upper end for connection to a high-pressure mandrel used to inject high-pressure fluids into the casing or the production tubing;

a first three-part packoff assembly that slides over the first cup tool tube, the first three-part pack off assembly including an elastomeric cup that surrounds the first cup tool tube, a rigid alignment ring that surrounds the first cup tool tube above the elastomeric cup, an annular groove in a bottom surface of the rigid alignment ring, and an elastomeric packoff element that surrounds the first cup tool tube above the rigid alignment ring;

a second cup tool tube having a threaded upper end for connection to a bottom end of the first cup tool tube; and a second three-part packoff assembly that slides over the second cup tool tube, the second three-part pack off assembly including a second elastomeric cup that surrounds the second cup tool tube, a second rigid alignment ring that surrounds the second cup tool tube above the second elastomeric cup, an annular groove in a bottom surface of the second rigid alignment ring, and a second elastomeric packoff element that surrounds the second cup tool tube above the second rigid alignment ring.

17. The cup tool as claimed in claim 16 further comprising a bullnose that terminates the second cup tool tube, the bullnose being adapted to guide the cup tool through the wellhead as the high pressure mandrel is inserted through the wellhead and into the casing or the production tubing.

18. The cup tool as claimed in claim 17 wherein the bullnose comprises a tool guide and a cup guard.

19. The cup tool as claimed in claim 16 wherein the elastomeric cup comprises a depending skirt below an inwardly biased lip that forms a seal around the cup tool tube and fluid pressure below the cup tool forces the elastomeric cup to slide upwardly on the cup tool tube.

20. The cup tool as claimed in claim 16 wherein the first and second rigid alignment rings respectively further comprise an O-ring groove in an inner surface thereof which accepts an O-ring to provide a fluid seal between the respective first and second rigid alignment rings and the respective first and second cup tool tubes.

* * * * *